US009766561B2

(12) United States Patent
Takahashi et al.

(10) Patent No.: US 9,766,561 B2
(45) Date of Patent: Sep. 19, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Koji Takahashi, Kashiwa (JP); Naoaki Ichihashi, Abiko (JP); Tsuyoshi Shimada, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/077,185

(22) Filed: Mar. 22, 2016

(65) Prior Publication Data

US 2016/0291488 A1 Oct. 6, 2016

(30) Foreign Application Priority Data

Mar. 31, 2015 (JP) ..... 2015-072654
Mar. 15, 2016 (JP) ..... 2016-051294

(51) Int. Cl.

| | |
|---|---|
| ***G03G 5/00*** | (2006.01) |
| ***G03G 5/07*** | (2006.01) |
| ***G03G 5/047*** | (2006.01) |
| ***G03G 5/05*** | (2006.01) |

(52) U.S. Cl.

CPC ..... *G03G 5/07* (2013.01); *G03G 5/047* (2013.01); *G03G 5/056* (2013.01); *G03G 5/0564* (2013.01); *G03G 2215/00957* (2013.01)

(58) Field of Classification Search

CPC ..... G03G 5/047; G03G 5/056; G03G 5/0564; G03G 5/07
USPC ..... 430/58.05, 96
See application file for complete search history.

(56) References Cited

U.S. PATENT DOCUMENTS

| | | | |
|---|---|---|---|
| 5,198,685 | A | 3/1993 | Kitani et al. |
| 5,534,375 | A | 7/1996 | Kaneko et al. |
| 6,444,384 | B2 | 9/2002 | Kawamorita et al. |
| 8,457,528 | B2 | 6/2013 | Ochi et al. |
| 8,865,380 | B2 | 10/2014 | Noguchi et al. |
| 9,114,565 | B2 | 8/2015 | Kawai et al. |

(Continued)

FOREIGN PATENT DOCUMENTS

| | | | |
|---|---|---|---|
| JP | 7-261422 | A | 10/1995 |
| JP | 2002-55466 | A | 2/2002 |
| JP | 2007-79555 | A | 3/2007 |

*Primary Examiner* — Mark A Chapman
(74) *Attorney, Agent, or Firm* — Fitzpatrick Cella Harper and Scinto

(57) ABSTRACT

The present invention provides an electrophotographic photosensitive member including a support, and a photosensitive layer on the support. The photosensitive layer has a charge generating layer containing a charge generating material and a charge transporting layer containing a charge transporting material, in this order. The charge transporting layer contains (α) a specific polycarbonate resin or a specific polyester resin, (β) the charge transporting material, (γ) a methoxybenzene, and (δ) a methoxybenzene, a methoxycyclohexane or a methylhexanol having a substituent. The content Wδ of the (δ) is 0.001% by mass or more and 1% by mass or less based on the total mass of the charge transporting layer.

7 Claims, 1 Drawing Sheet

(56) References Cited

U.S. PATENT DOCUMENTS

| | | | | |
|---|---|---|---|---|
| 2004/0081902 | A1* | 4/2004 | Lee | G03G 5/047 430/58.6 |
| 2014/0093281 | A1 | 4/2014 | Takahashi et al. | |
| 2015/0241799 | A1 | 8/2015 | Takahashi et al. | |
| 2015/0286182 | A1 | 10/2015 | Mitsui et al. | |

* cited by examiner

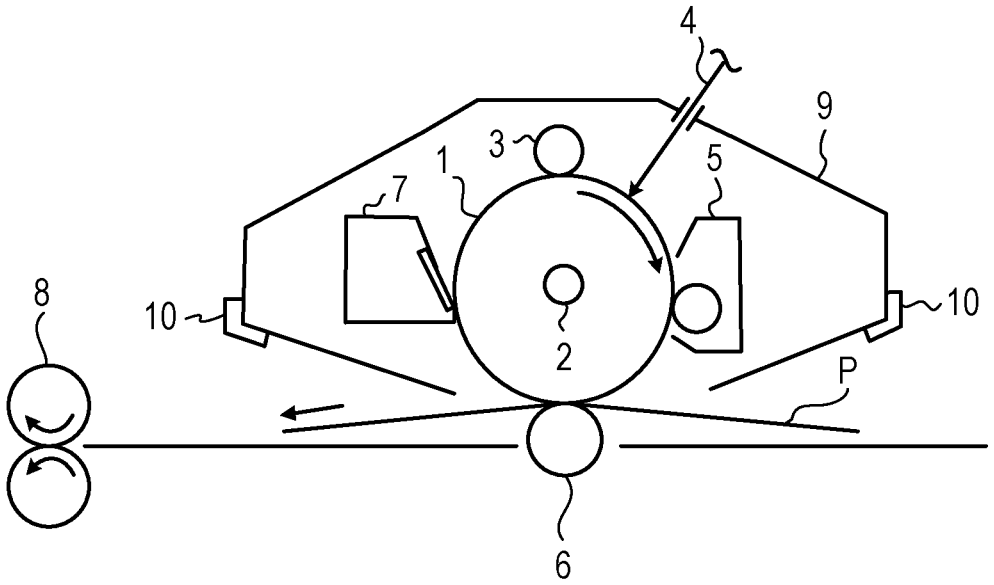
4
9
3
1
5
7
8
10
10
2
P
6

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, a process cartridge and an electrophotographic apparatus.

Description of the Related Art

Recently users of electrophotographic apparatuses have been more diversified and higher image quality and higher stability are required in an output image more than ever before. Accordingly, the high image quality and high stability of an electrophotographic photosensitive member to be installed on electrophotographic apparatuses is required to be further improved.

As a technique for achieving excellent properties of an electrophotographic photosensitive member for a long period from the initial stage of image formation, in Japanese Patent Application Laid-Open No. 2002-55466, a technique for forming a charge transporting layer by drying a coat formed from a coating liquid which contains a charge transporting material, a binder resin, dimethoxymethane and an aromatic hydrocarbon solvent having a boiling point of 130° C. or higher is disclosed. Specifically, in Japanese Patent Application Laid-Open No. 2002-55466, a technique using anisole (methoxybenzene) as the aromatic hydrocarbon solvent is disclosed.

In Japanese Patent Application Laid-Open No. H07-261422, a charge transporting layer composition and an electrophotographic photosensitive member which contain an aromatic ether as solvent are described.

In Recent years, electrophotographic apparatuses have been installed in all over the world with the physical distribution to cover all over the world. Accordingly, electrophotographic apparatuses and electrophotographic photosensitive members are required to be improved in resistance to environment (low dependence on environment), such that the properties of electrophotographic photosensitive members are hardly changed by the difference in temperature and humidity between installation locations or by the change in temperature and humidity during physical distribution.

However, in the case of using methoxybenzene in manufacturing an electrophotographic photosensitive member as described in Japanese Patent Application Laid-Open No. 2002-55466, cracks were generated in the electrophotographic photosensitive member in some cases when stored in a high-temperature and high-humidity environment and then stored in a normal temperature environment, probably due to precipitation of the charge transporting material.

In the case of using an aromatic ether in manufacturing an electrophotographic photosensitive member as described in Japanese Patent Application Laid-Open No. H07-261422 also, the storage in the similar environment caused the similar cracks in some cases.

In both cases, the cause is presumed to be the presence of methoxybenzene (aromatic ether) in the charge transporting layer of the electrophotographic photosensitive member, for use in manufacturing the electrophotographic photosensitive member.

SUMMARY OF THE INVENTION

The present invention is directed to providing an electrophotographic photosensitive member in which an occurrence of cracks in a charge transporting layer containing methoxybenzene and the resultant image defects are suppressed, a process cartridge and an electrophotographic apparatus having the electrophotographic photosensitive member.

According to one aspect of the present invention, there is provided an electrophotographic photosensitive member having a support, and a photosensitive layer on the support, wherein, the photosensitive layer comprises:

a charge generating layer containing a charge generating material, and a charge transporting layer containing a charge transporting material, in this order;

the charge transporting layer contains:

(α) at least one selected from the group consisting of a polycarbonate resin having a structural unit represented by the following formula (A), and a polyester resin having a structural unit represented by the following formula (B);

(β) the charge transporting material;

(γ) a methoxybenzene; and (δ) at least one compound selected from the group consisting of:

a methoxycyclohexane, a methylhexanol and a methoxybenzene having a methyl group or an ethyl group as a substituent; and the content Wδ of the (δ) is 0.001% by mass or more and 1% by mass or less based on the total mass of the charge transporting layer.

(A)

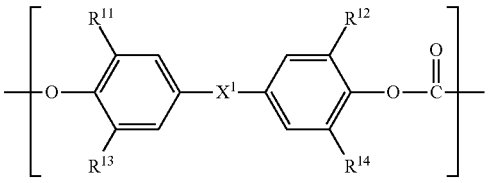

(B)

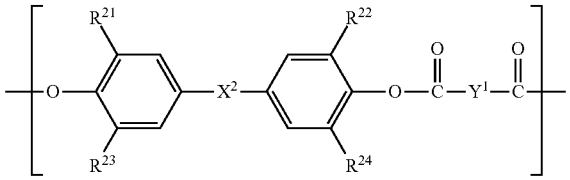

In the formulae (A) and (B), $R^{11}$ to $R^{14}$, and $R^{21}$ to $R^{24}$ each independently represent a hydrogen atom, a methyl group or an ethyl group. $X^1$ and $X^2$ each independently represent a single bond or a divalent hydrocarbon group. $Y^1$ represents a phenylene group or a diphenylene ether group.

According to another aspect of the present invention, there is provided a process cartridge detachably attachable to a main body of an electrophotographic apparatus, wherein the process cartridge integrally supports:

the electrophotographic photosensitive member; and at least one device selected from the group consisting of:

a charging device for charging the electrophotographic photosensitive member;

an exposing device for forming an electrostatic latent image on the surface of the electrophotographic photosensitive member by irradiating the surface of the electrophotographic photosensitive member with exposure light;

a developing device for forming a toner image on the surface of the electrophotographic photosensitive member by toner development of the electrostatic latent image;

a transfer device for transferring the toner image from the surface of the electrophotographic photosensitive member to a transfer material; and a cleaning device for cleaning the surface of the electrophotographic photosensitive member.

According to still another aspect of the present invention, there is provided an electrophotographic apparatus including:

the electrophotographic photosensitive member;

a charging device for charging the electrophotographic photosensitive member;

an exposing device for forming an electrostatic latent image on the surface of the electrophotographic photosensitive member by irradiating the surface of the electrophotographic photosensitive member with exposure light;

a developing device for forming a toner image on the surface of the electrophotographic photosensitive member by toner development of the electrostatic latent image; and a transfer device for transferring the toner image from the surface of the electrophotographic photosensitive member to a transfer material.

The present invention can provide an electrophotographic photosensitive member in which image defects caused by cracks in the charge transporting layer containing methoxybenzene is suppressed, and a process cartridge and an electrophotographic apparatus having the electrophotographic photosensitive member.

Further features of the present invention will become apparent from the following description of exemplary embodiments with reference to the attached drawing.

BRIEF DESCRIPTION OF THE DRAWING

FIGURE is a schematic view illustrating a configuration example of an electrophotographic apparatus equipped with a process cartridge having an electrophotographic photosensitive member of the present invention.

DESCRIPTION OF THE EMBODIMENTS

Preferred embodiments of the present invention will now be described in detail in accordance with the accompanying drawing.

An electrophotographic photosensitive member of the present invention includes a support, and a photosensitive layer on the support, in which, the photosensitive layer has:

a charge generating layer containing a charge generating material, and a charge transporting layer containing a charge transporting material, in this order, the charge transporting layer contains:

(α) at least one selected from the group consisting of a polycarbonate resin having a structural unit represented by the following formula (A), and a polyester resin having a structural unit represented by the following formula (B);

(β) the charge transporting material;

(γ) a methoxybenzene; and (δ) at least one compound selected from the group consisting of:

a methoxycyclohexane, a methylhexanol, and a methoxybenzene having a methyl group or an ethyl group as a substituent; and the content Wδ of the (δ) is 0.001% by mass or more and 1% by mass or less based on the total mass of the charge transporting layer.

(A)

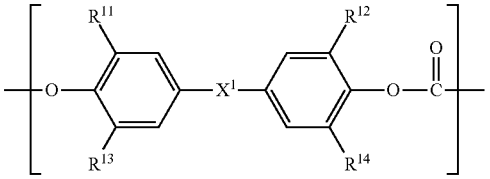

(B)

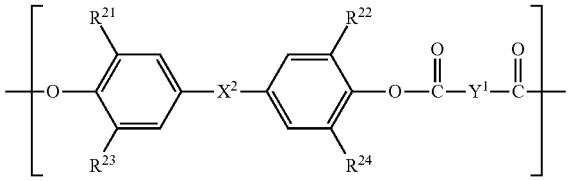

In the formulae (A) and (B), $R^{11}$ to $R^{14}$, and $R^{21}$ to $R^{24}$ each independently represent a hydrogen atom, a methyl group, or an ethyl group. $X^1$ and $X^2$ each independently represent a single bond or a divalent hydrocarbon group. $Y^1$ represents a phenylene group or a diphenylene ether group.

Hereinafter the (α) is also referred to as "resin α", the (β) is also referred to as "compound β", the (γ) is also referred to as "compound γ", and the (δ) is also referred to as "compound δ".

First, the effect development mechanism presumed by the present inventors is described.

The electrophotographic photosensitive member of the present invention includes a charging transporting layer which contains a methoxybenzene (compound γ) and a specific amount of a compound (compound δ) having a structure similar to the methoxybenzene.

The present inventors presume the reason why the occurrence of cracks in the charge transporting layer probably caused by precipitation of the charge transporting material and the image defects derived from the cracks can be suppressed by inclusion of the compound δ in the charge transporting layer as follows.

In a high-temperature and high-humidity environment, the mobility of molecules is enhanced, so that the charge transporting material and the methoxybenzene move to a state stable to each other in the charge transporting layer. As a result of study by the present inventors, it is presumed that the coexistence of a charge transporting material and a methoxybenzene allows the packing structure of the charge transporting material with the methoxybenzene to be extremely stable energetically. Consequently, even an extremely small amount of the methoxybenzene contained in the charge transporting layer enhances the mobility of molecules in a high-temperature and high humidity environment. The subsequent storage at normal temperature results in stabilization with a more stable packing structure than before the storage at high-temperature and high-humidity, so that the charge transporting material is crystallized. In contrast, it is presumed that the compound δ having a structure similar to the methoxybenzene has a function to efficiently inhibit the interaction between the methoxybenzene and the charge transporting material.

The resin α, the compound β, the compound γ and the compound δ to constitute the charge transporting layer of the electrophotographic photosensitive member of the present invention are described as follows.

<Resin α>

The resin α is at least one resin selected from the group consisting of a polycarbonate resin having a structural unit (repeating structural unit) represented by the following formula (A), and a polyester resin having a structural unit (repeating structural unit) represented by the following formula (B).

(A)

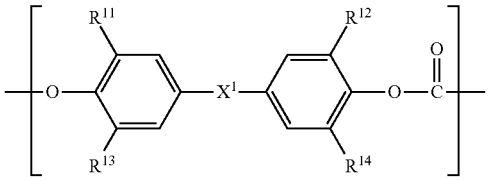

(B)

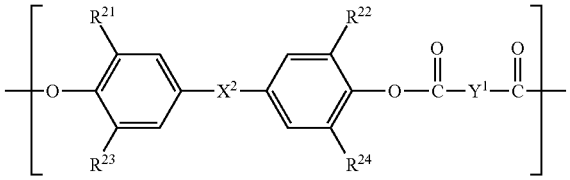

In the formula (A), $R^{11}$ to $R^{14}$ each independently represent a hydrogen atom, a methyl group, or an ethyl group. $R^{11}$ to $R^{14}$ each independently can be a hydrogen atom or a methyl group.

In the formula (A), $X^1$ represents a single bond or a divalent hydrocarbon group. $X^1$ can be a single bond, a cyclohexylidene group, or a divalent group having a structure represented by the following formula (C).

In the formula (B), $R^{21}$ to $R^{24}$ each independently represent a hydrogen atom, a methyl group, or an ethyl group. $R^{21}$ to $R^{24}$ each independently can be a hydrogen atom or a methyl group.

In the formula (B), $X^2$ represents a single bond or a divalent hydrocarbon group. $X^2$ can be a single bond, a cyclohexylidene group, or a divalent group having a structure represented by the following formula (C).

In the formula (B), $Y^1$ represents a phenylene group or a diphenylene ether group. The phenylene group can be a m-phenylene group or a p-phenylene group. The diphenylene ether group can be a divalent group having two p-phenylene groups bonded through an oxygen atom (also referred to as 4,4'-diphenylene ether group or p,p'-diphenylene ether group).

(C)

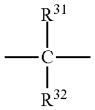

In the formula (C), $R^{31}$ and $R^{32}$ each independently represent a hydrogen atom, a methyl group, or a phenyl group.

Specific examples of the structural unit represented by the formula (A) are described as follows.

(A-1)

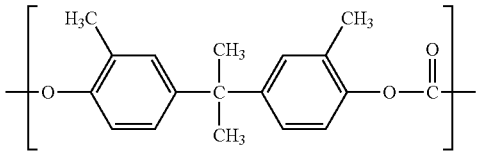

(A-2)

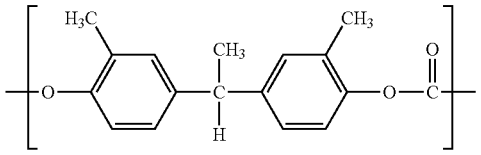

(A-3)

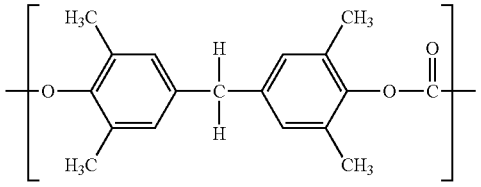

(A-4)

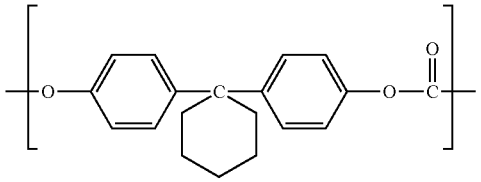

(A-5)

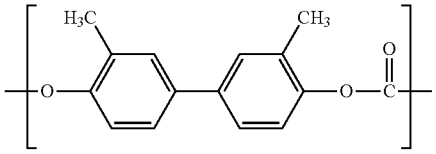

(A-6)

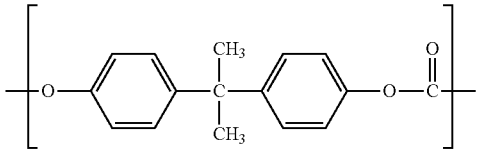

(A-7)

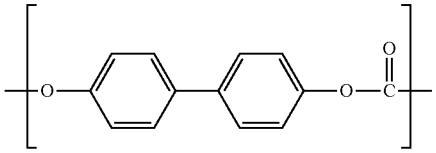

(A-8)

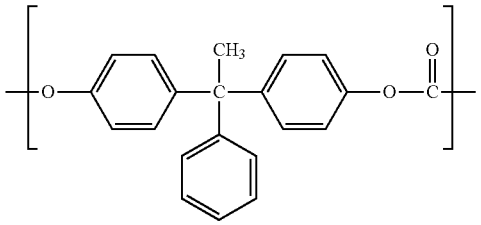

Among these, (A-1), (A-2) and (A-4) are preferred.

The polycarbonate resin having a structural unit represented by the formula (A) may be a polycarbonate resin including a homopolymer having one kind of structural unit represented by the formula (A) or may be a polycarbonate resin including a copolymer having two or more kinds of structural units.

Specific examples of the structural unit represented by the formula (B) are described as follows.
(B-1)
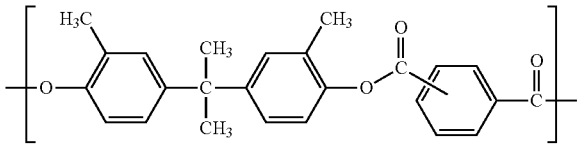
(B-2)
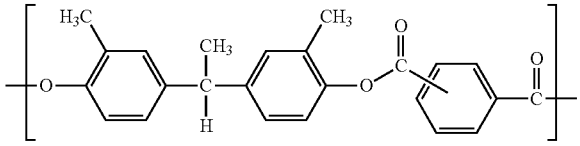
(B-3)
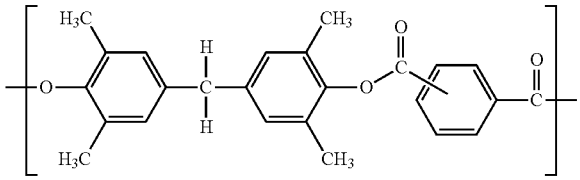
(B-4)
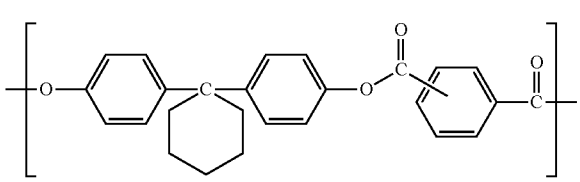
(B-5)
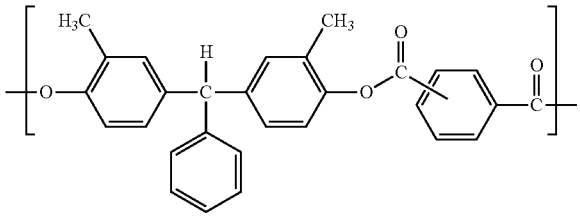
(B-6)
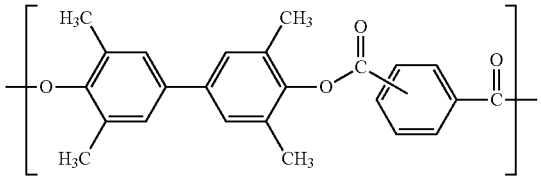
(B-7)
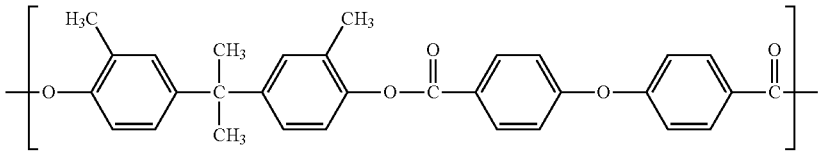
(B-8)
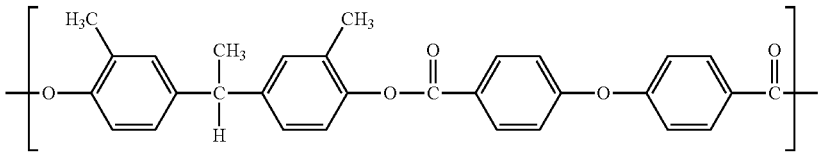

-continued (B-9)

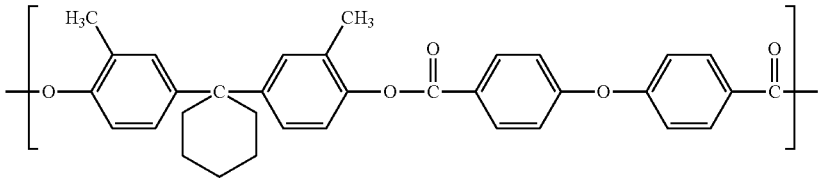

Among these, (B-1), (B-2), (B-3), (B-6), (B-7) and (B-8) are preferred.

The polyester resin having a structural unit represented by the formula (B) may be a polyester resin including a homopolymer having one kind of structural unit represented by the formula (B) or may be a polyester resin including a copolymer having two or more kinds of structural units.

Hereinafter the polycarbonate resin having a structural unit represented by the formula (A) is also referred to as "polycarbonate resin A", and the polyester resin having a structural unit represented by the formula (B) is also referred to as "polyester resin B".

The polycarbonate resin A may be synthesized by, for example, a known phosgene method, and the polyester resin B may be synthesized by, for example, a known transesterification method.

In the case of the polycarbonate resin A and the polyester resin B being copolymers, the copolymers may be in any form such as a block copolymer, a random copolymer, and an alternating copolymer.

The polycarbonate resin A and the polyester resin B have a weight average molecular weight of preferably 20,000 or more and 300,000 or less, more preferably 50,000 or more and 250,000 or less.

The weight average molecular weight of a resin in the present invention is the weight average molecular weight in terms of polystyrene measured by the method described in Japanese Patent Application Laid-Open No. 2007-79555.

The polycarbonate resin A and the polyester resin B may be a copolymer having a structural unit including a siloxane structure in addition to the structural unit represented by the formula (A) or the formula (B).

Specific examples of the structural unit which includes a siloxane structure are described as follows.

(D-1)

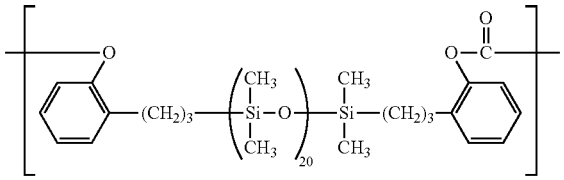

(D-2)

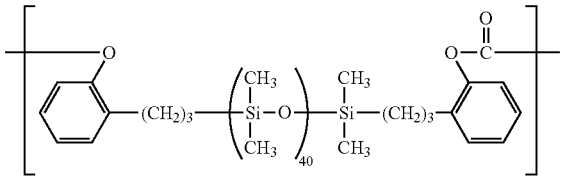

-continued (D-3)

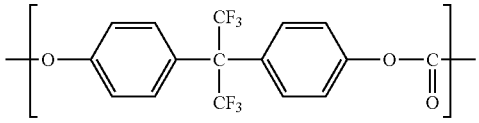

Specific examples of the resin α are described as follows.

TABLE 1

| Resin α (polycarbonate resin A and polyester resin B) | Structural unit | Ratio of each structural unit (mass ratio) | Weight average molecular weight (Mw) |
|---|---|---|---|
| Resin A1 | A-4 | — | 55000 |
| Resin A2 | A-6 | — | 55000 |
| Resin A3 | A-1 | — | 54000 |
| Resin A4 | A-4/D-1 | 9/1 | 110000 |
| Resin B1 | B-1 | — | 120000 |
| Resin B2 | B-1/B-6 | 7/3 | 120000 |
| Resin B3 | B-8 | — | 100000 |

<Compound β>

The compound β is a charge transporting material. The charge transporting material may include one kind of material alone or two or more kinds of materials. Examples of the charge transporting material include a triarylamine compound, a hydrazone compound, a styryl compound, a stilbene compound, and an enamine compound.

In the present invention, the charge transporting material can be a charge transporting material having a partial structure represented by the following formula (E).

(E)

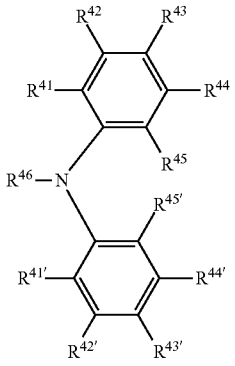

In the formula (E), $R^{41}$ to $R^{46}$, and $R^{41'}$ to $R^{45'}$ each independently represent a hydrogen atom, a methyl group, an ethyl group, a substituted or unsubstituted aryl group, or an unsaturated hydrocarbon group.

Examples of the unsaturated hydrocarbon group include an unsaturated hydrocarbon group such as a substituent having an unsaturated bond such as butadiene.

Examples of the aryl group include a phenyl group, a biphenyl group and a fluorenyl group. Examples of the substituent which the aryl group may have include a substituted or unsubstituted alkyl group, a substituted or unsubstituted alkenyl group, and a substituted or unsubstituted amino group.

Compounds represented by the following structural formulae (E-1) to (E-9) are more preferred.

In the present invention, the charge transporting material can have a molecular weight of 3,000 or less.

(E-1)

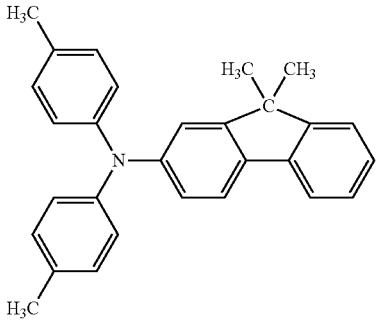

(E-2)

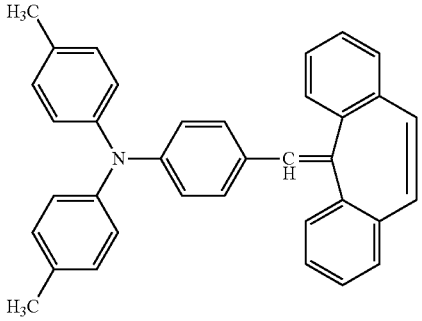

(E-3)

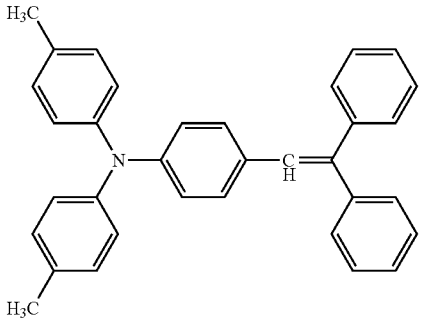

(E-4)

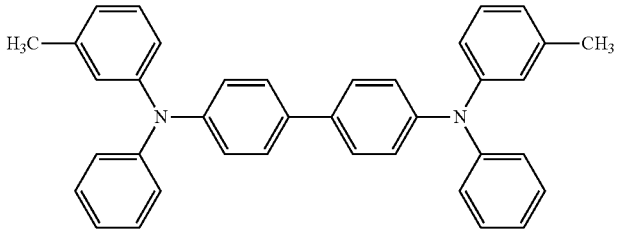

-continued
(E-5)
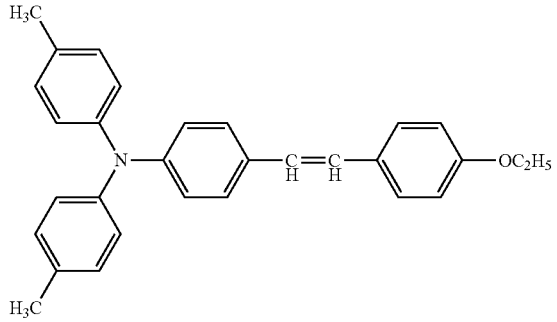
(E-6)
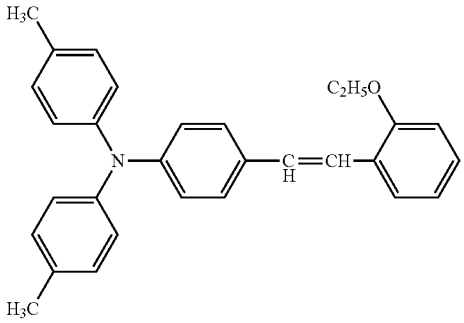
(E-7)
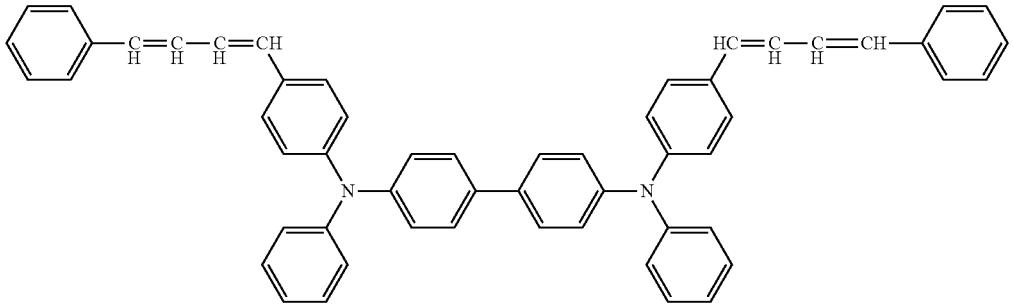
(E-8)
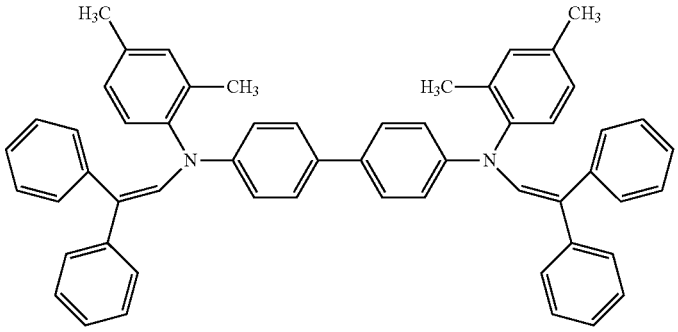
(E-9)
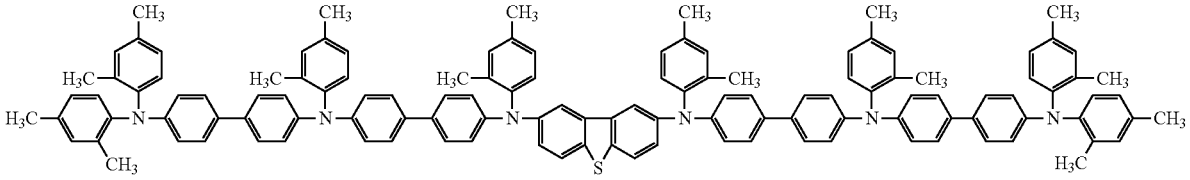

<Compound δ>

The compound δ is at least one compound selected from the group consisting of a methoxycyclohexane, a methylhexanol, and a methoxybenzene having a substituent.

The charge transporting layer of the electrophotographic photosensitive member of the present invention contains the compound δ.

The methoxybenzene having a substituent can be a compound with a structure represented by the following formula (F).

(F)

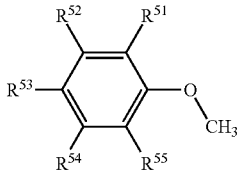

In the formula (F), $R^{51}$ to $R^{55}$ each independently represent a hydrogen atom, a methyl group or an ethyl group. At least one of $R^{51}$ to $R^{55}$ is a methyl group or an ethyl group.

Among the compounds represented by the formula (F), methoxytoluene, which has a structure similar to the methoxybenzene, is preferred, from the viewpoint of efficiently suppressing precipitation of charge transporting materials. Among the methoxytoluenes, 2-methoxytoluene in which $R^{51}$ is a methyl group and others are hydrogen atoms, and 4-methoxytoluene in which $R^{53}$ is a methyl group and others are hydrogen atoms are more preferred.

<Content Wγ of Compound γ and Content Wδ of Compound δ>

By controlling the content Wδ of the compound δ in the charge transporting layer in a preferred range, the effect for suppressing the occurrence of cracks in the charge transporting layer can be obtained. The content Wδ can be 0.001% by mass or more and 1% by mass or less based on the total mass of the charge transporting layer. The effect for suppressing the occurrence of cracks in the charge transporting layer may not be obtained with a too small or too large amount in some cases.

The content Wγ of the compound γ can be 0.001% by mass or more and 2% by mass or less based on the total mass of the charge transporting layer. The content Wγ of the compound γ and the content Wδ of the compound δ more preferably satisfy the following (α), (b) and (c), from the viewpoints of more effectively suppressing the occurrence of cracks and suppressing the deformation caused by a contact member when left standing for a long time.

(a) The content Wγ of the compound γ in the charge transporting layer is 0.001% by mass or more and 1% by mass or less.

(b) The content Wδ of the compound δ in the charge transporting layer is 0.001% by mass or more and 0.5% by mass or less.

(C) The ratio of the content Wγ of the compound γ to the content Wδ of the compound δ, Wγ/Wδ, is 0.5 or more and 200 or less.

In order to more effectively suppress precipitation of the charge transporting material, it is presumed that the compound γ and the compound δ can be present in the charge transporting layer at a more preferred ratio.

The content Wγ of the compound γ and the content Wδ of the compound δ in the charge transporting layer can be obtained by a measurement method described below.

In the present invention, the measurement is performed by using quadrupole GC/MS system TRACE ISQ (manufactured by Thermo Fisher Scientific, Inc.).

A test piece of 5 mm by 40 mm is cut out from the manufactured electrophotographic photosensitive member.

The test piece is placed in a vial container. A head space sampler (TurboMatrix HS40 (manufactured by Perkin Elmer Corporation)) is set as follows: Oven at 200° C., Loop at 205° C., and Transfer Line at 205° C. The generated gas is measured by gas chromatography. The mass of the charge transporting layer of a test piece can be obtained from the difference between the mass of a test piece taken out from the vial container after measurement and the mass of the taken-out test piece in which the charge transporting layer has been removed. The test piece in which the charge transporting layer has been removed is prepared by immersing the test piece in methyl ethyl ketone for 5 minutes for removal of the charge transporting layer and drying the test piece at 50° C. for 5 minutes.

In the present invention, the content Wγ of the compound γ and the content Wδ of the compound δ in the charge transporting layer were measured by the above-mentioned method.

<Structure of Electrophotographic Photosensitive Member>

The structure of the electrophotographic photosensitive member of the present invention is described as follows.

The electrophotographic photosensitive member of the present invention is an electrophotographic photosensitive member having a support and a photosensitive layer on the support.

The photosensitive layer of the electrophotographic photosensitive member of the present invention is a lamination type photosensitive layer (function-separated photosensitive layer) in which a charge generating layer including a charge generating material and a charge transporting layer including a charge transporting material are laminated. The laminated photosensitive layer is a photosensitive layer (regular-layer type photosensitive layer) including a charge generating layer and a charge transporting layer, which are laminated in this order from the support side. The charge generating layer may have a lamination structure (multilayer structure), or the charge transporting layer may have a lamination structure (multilayer structure).

The support can be formed of material having electro-conductive properties (electro-conductive support). Examples of the material for the support include a metal (alloy) such as iron, copper, gold, silver, aluminum, zinc, titanium, lead, nickel, tin, antimony, indium, chromium, an aluminum alloy and stainless steel.

Alternatively, a metal support or a plastic support having a coating film formed by vacuum deposition of, for example, aluminum, an aluminum alloy, and an indium oxide-tin oxide alloy may be used as the support.

Alternatively, a plastic or paper support impregnated with an electro-conductive particle such as carbon black, a tin oxide particle, a titanium oxide particle, and a silver particle, or a support formed of electro-conductive binder resin may be used.

The surface of the support may be subjected to, for example, machining, roughening, and alumite treatment, in order to suppressing interference fringes caused by scattering of laser light.

An electro-conductive layer may be disposed between the support and the charge generating layer or the below-mentioned undercoat layer, in order to, for example, suppress interference fringes caused by scattering of laser light and cover scratches of the support.

The electro-conductive layer can be formed by applying a coating liquid for an electro-conductive layer, which is obtained by dispersing carbon black, an electro-conductive pigment, a resistance adjusting pigment with a binder resin in a solvent, to form a coat, and drying the resultant coat. The coating liquid for an electro-conductive layer may contain, for example, a compound to be cured and polymerized by heating, UV exposure, or radiation exposure.

Examples of the binder resin for use in the electro-conductive layer include an acrylic resin, an allyl resin, an alkyd resin, an ethyl cellulose resin, an ethylene-acrylic acid co-polymer, an epoxy resin, a casein resin, a silicone resin, a gelatin resin, a phenol resin, a butyral resin, a polyacrylate resin, a polyacetal resin, a polyamideimide resin, a polyamide resin, a polyallylether resin, a polyimide resin, a polyurethane resin, a polyester resin, a polycarbonate resin, and a polyethylene resin.

Examples of the electro-conductive pigment and the resistance adjusting pigment include a particle of a metal (alloy) such as aluminum, zinc, copper, chromium, nickel, silver and stainless steel, and a plastic particle having a surface vapor-deposited with the metal (alloy). Alternatively, a particle of a metal oxide such as zinc oxide, titanium oxide, tin oxide, antimony oxide, indium oxide, bismuth oxide, indium oxide doped with tin, and tin oxide doped with antimony or tantalum may be used. One kind of these may be used alone, or two or more kinds of these may be used in combination.

Further, the electro-conductive pigment and the resistance adjusting pigment may be subjected to surface treatment. Examples of the surface treatment agent include a surfactant, a silane coupling agent and a titanium coupling agent.

In order to achieve light scattering, the electro-conductive layer may contain a particle such as a silicone resin particle and an acrylic resin particle.

Further, the electro-conductive layer may contain an additive such as a leveling agent, a dispersant, an antioxidant, a UV absorber, a plasticizer and a rectifying material.

The electro-conductive layer has a film thickness of, preferably 0.2 μm or more and 40 μm or less, more preferably 1 μm or more and 35 μm or less, furthermore preferably 5 μm or more and 30 μm or less.

An undercoat layer (intermediate layer) may be disposed between the support or the electro-conductive layer and the charge generating layer in order to improve the bondability of the photosensitive layer and the charge injection properties from the support.

The undercoat layer can be formed by forming a coat from a coating liquid for an undercoat layer, which is obtained by dissolving a binder resin in a solvent, and drying the coat.

Examples of the resin for use in the undercoat layer include a polyvinyl alcohol resin, a polyethylene oxide resin, an ethyl cellulose resin, a methyl cellulose resin, a casein resin, a polyamide resin (nylon 6, nylon 66, nylon 610, a copolymer nylon, and N-alkoxymethylated nylon and the like), a polyurethane resin, an acrylic resin, an allyl resin, an alkyd resin, a phenol resin, and an epoxy resin.

The undercoat layer can have a film thickness of 0.05 μm or more and 40 μm or less.

The undercoat layer may contain a metal oxide particle.

The metal oxide particle for use in the undercoat layer can be, for example, a particle which contains at least one selected from the group consisting of titanium oxide, zinc oxide, tin oxide, zirconium oxide and aluminum oxide. Among the particles which contain the metal oxide, a particle containing zinc oxide is more preferred.

The metal oxide particle may be a metal oxide particle of which the surface is treated with a surface treatment agent such as a silane coupling agent.

Examples of the dispersion method include a method using a homogenizer, a ultrasonic dispersion machine, a ball mill, a sand mill, a roll mill, an oscillating mill, an attritor, and a liquid collision type high-speed dispersion machine.

The undercoat layer may contain, for example, an organic resin particle or a leveling agent in order to adjust the surface roughness of the undercoat layer or reduce cracks in the undercoat layer.

Examples of the organic resin particle include a hydrophobic organic resin particle such as a silicone particle and a hydrophilic organic resin particle such as a cross-linked polymethacrylate resin (PMMA) particle.

The undercoat layer may contain various additives.

Examples of the additives include a metal, an electro-conductive material, an electron transporting material, a metal chelate compound, and an organometallic compound such as a silane coupling agent.

The charge generating layer can be formed by applying a coating liquid for a charge generating layer, which is obtained by dispersing a charge generating material together with a binder resin and a solvent to form a coat, and drying the coat. Alternatively, the charge generating layer may be a vapor deposition film of a charge generating material.

Examples of the charge generating material for use in the charge generating layer include an azo pigment, a phthalocyanine pigment, an indigo pigment, a perylene pigment, a polycyclic quinone pigment, a squarylium coloring matter, a thiapyrylium salt, a triphenylmethane coloring matter, a quinacridone pigment, an azulenium salt pigment, a cyanine dye, an anthanthrene pigment, a pyranthrone pigment, a xanthene coloring matter, a quinone imine coloring matter, and a styryl coloring matter.

One kind of these charge generating materials may be used, or two or more kinds may be used.

Among them, oxytitanium phthalocyanine, chlorogallium phthalocyanine and hydroxygallium phthalocyanine are preferred from the viewpoint of sensitivity.

Preferred examples of the hydroxygallium phthalocyanine include a hydroxygallium phthalocyanine crystal in a crystal form having strong peaks at Bragg angles $2\theta$ of $7.4°\pm0.3°$ and $28.2°\pm0.3°$ in CuKα characteristic X-ray diffraction.

Examples of the binder resin for use in the charge generating layer include a polycarbonate resin, a polyester resin, a butyral resin, a polyvinyl acetal resin, an acrylic resin, a polyvinyl acetate resin, and a urea resin. Among them, a butyral resin is preferred. One kind or two or more kinds of these may be used alone, mixed, or copolymerized.

Examples of the dispersion method include a method using a homogenizer, an ultrasonic dispersion machine, a ball mill, a sand mill, a roll mill and an attritor.

The ratio of the charge generating material to the binder resin in a charge generating layer can be 0.3 parts by mass or more and 10 parts by mass or less of the charge generating material based on 1 part by mass of the binder resin.

The charge generating layer may contain, for example, a sensitizer, a leveling agent, a dispersant, an antioxidant, a UV absorber, a plasticizer and a rectifying material on an as needed basis.

The charge generating layer has a film thickness of preferably 0.01 μm or more and 5 μm or less, more preferably 0.1 μm or more and 2 μm or less.

A charge transporting layer is formed on the charge generating layer.

The charge transporting layer can be formed by applying a coating liquid for a charge transporting layer, which is obtained by dissolving a charge transporting material and a binder resin in a solvent, to form a coat, and drying the coat.

Examples of the charge transporting material as compound β include a pyrene compound, an N-alkylcarbazole compound, an N,N-dialkylaniline compound, a diphenylamine compound, a triphenylamine compound, a triphenylmethane compound, a pyrazoline compound and a butadiene compound, besides a triarylamine compound, a hydrazone compound, a styryl compound, a stilbene compound and an enamine compound, which are mentioned above. One of the charge transporting materials may be used alone, or two or more thereof may be used. The charge transporting material can be a charge transporting material having a partial structure represented by the following formula (E) from the viewpoint of suppressing the occurrence of cracks in the charge transporting layer. A compound represented by any one of the formulae (E-1) to (E-9) is more preferred.

The binder resin for use in the charge transporting layer can be a polycarbonate resin A having a structural unit represented by the formula (A) or a polyester resin B having a structural unit represented by the formula (B), i.e., a resin α. The charge transporting layer may contain, for example, an acrylic resin, a polyvinyl carbazole resin, a phenoxy resin, a polyvinyl butyral resin, a polystyrene resin, a polyvinyl acetate resin, a polysulfone resin, a polyvinylidene chloride resin, an acrylonitrile copolymer, or a polyvinyl benzal resin, with the resin α. One kind or two or more kinds of these may be used alone, mixed, or copolymerized.

The ratio of the charge transporting material to the binder resin in a charge transporting layer can be 0.3 parts by mass or more and 3 parts by mass or less of the charge transporting material based on 1 part by mass of the binder resin.

The charge transporting layer formed of one layer has a film thickness of preferably 5 μm or more and 40 or less, more preferably 8 μm or more and 40 μm or less. In the case of the charge transporting layer having a laminated structure, the charge transporting layer on the support side can have a film thickness or 5 μm or more and μm or less and the charge transporting layer on the surface side can have a film thickness of 1 μm or more and 10 μm or less.

Examples of the solvent for use in the coating liquid for a charge transporting layer include an alcoholic solvent, a sulfoxide solvent, a ketone solvent, an ether solvent, and an ester solvent besides the methoxybenzene (anisole) as the above-mentioned compound γ. Specific examples include xylene, toluene and tetrahydrofuran.

The charge transporting layer of the electrophotographic photosensitive member of the present invention contains a compound δ.

The charge transporting layer may contain, for example, an antioxidant, a UV absorber, a plasticizer, a leveling agent, an organic particle, and an inorganic particle together with the compound δ on an as needed basis.

Examples of the antioxidant include a hindered phenol antioxidant, a hindered amine light stabilizer, a sulfur atom-containing antioxidant, and a phosphorus atom-containing antioxidant.

Examples of the organic particle include a resin particle such as a fluorine atom-containing resin particle, a polystyrene particle and a polyethylene resin particle.

Examples of the inorganic particle include a metal oxide particle such as silica and alumina.

A protective layer may be formed on the charge transporting layer in order to improve the abrasion resistance and the cleaning properties of the electrophotographic photosensitive member.

The protective layer can be formed by forming a coat from a coating liquid for a protective layer, which is obtained by dissolving a binder resin in a solvent, and drying the coat.

Examples of the binder resin for use in the protective layer include a polyvinyl butyral resin, a polyester resin, a polycarbonate resin, a polyamide resin, a polyimide resin, a polyurethane resin and a phenol resin.

Alternatively the protective layer may be formed by forming a coat from a coating liquid for a protective layer, which is obtained by dissolving a polymerizable monomer or oligomer in a solvent, and curing (polymerizing) the coat by cross-linking or polymerization.

Examples of the polymerizable monomer or oligomer include a compound having a chain polymerizable functional group such as an acryloyl oxy group, a methacryloyl oxy group and a styryl group, and a compound having a sequentially polymerizable functional group such as a hydroxyl group, an alkoxysilyl group, an isocyanate group and an epoxy group.

Examples of the curing reaction include a radical polymerization, an ionic polymerization, a thermal polymerization, a photo polymerization, a radiation polymerization (electron beam polymerizing), a plasma CVD and a photo CVD.

The protective layer may further contain an electro-conductive particle or a charge transporting material.

As the electro-conductive particle, for example, the above-mentioned electro-conductive pigment for use in the electro-conductive layer can be used. As the charge transporting material, for example, the above-mentioned charge transporting material for use in the charge transporting layer can be used.

Use of a charge transporting material having a polymerizable functional group is more preferred from the viewpoint of satisfying both of the abrasion resistance and the charge transporting capacity. An acryloyl oxy group can be used as the polymerizable functional group. A charge transporting material having two or more polymerizable functional groups in the same molecule can be also used.

The surface layer (charge transporting layer or protective layer) of the electrophotographic photosensitive member may contain an organic resin particle or an inorganic particle.

Examples of the organic resin particle include a fluorine atom-containing organic resin particle and an acrylic resin particle.

Examples of the inorganic particle include particles of alumina, silica and titania.

The surface layer (charge transporting layer or protective layer) of the electrophotographic photosensitive member may contain an electro-conductive particle, an antioxidant, a UV absorber, a plasticizer, a leveling agent, or the like.

The protective layer has a film thickness of preferably 0.1 μm or more and 30 μm or less, more preferably 1 μm or more and 10 μm or less.

Examples of the method for applying the coating liquid for each of the layers include a dip coating method (immersion coating method), a spray coating method, a spinner coating method, a roller coating method, a Meyer bar coating method and a blade coating method.

<Structure of Process Cartridge and Electrophotographic Apparatus>

In FIGURE, an example of the electrophotographic apparatus equipped with a process cartridge having the electrophotographic photosensitive member of the present invention is illustrated.

In FIGURE, a cylindrical electrophotographic photosensitive member 1 is rotary-driven in the arrow direction (clockwise direction) around an axis 2 at a specified circumferential rate (process speed). The surface of the electrophotographic photosensitive member 1 is uniformly charged at a specified positive or negative potential with a charging device 3 (e.g. charging roller) in a rotation process. The charged surface of the electrophotographic photosensitive member 1 is then irradiated with exposure light (image exposure light) 4 from an exposing device (image exposing device) (not shown in drawing), so that an electrostatic latent image is formed corresponding to objective image data. The exposure light 4 is intensity-modulated light corresponding to the time-series electric digital image signals of objective image data outputted from, for example, a slit exposure-type or laser beam scanning exposure-type exposing device.

The electrostatic latent image formed on the surface of the electrophotographic photosensitive member 1 is developed (normal development or reversal development) with a developer (toner) accommodated in a developing device 5, so that a toner image is formed on the surface of the electrophotographic photosensitive member 1. The toner image formed on the electrophotographic photosensitive member 1 is transferred on a transfer material P by a transfer bias from a transfer device (e.g. transfer roller) 6. On this occasion, the transfer material P is taken out from a transfer material supply device (not shown in drawing) in synchronization with the rotation of the electrophotographic photosensitive member 1 so as to be fed between the electrophotographic photosensitive member 1 and the transfer device 6 (contact section). A bias voltage having a reverse polarity to the charge which toner possesses is applied to the transfer device from a bias power source (not shown in drawing).

The transfer material P with a transferred toner image is separated from the surface of the electrophotographic photosensitive member 1 and fed to a fixing device 8. The transfer material P with a transferred toner image is then subjected to fixing treatment of the toner image to be printed out as an image formed material (print or copy) and discharged outside of the electrophotographic apparatus 1.

After the toner image is transferred to the transfer material P, the surface of the electrophotographic photosensitive member 1 is cleaned by a cleaning device 7 to remove adhered substance such as residual developer remaining after transfer (residual toner remaining after transfer).

Further, the surface of the electrophotographic photosensitive member 1 is irradiated with pre-exposure light from a pre-exposing device (not shown in drawing), and subjected to neutralization to cancel electrical charges so as to be repeatedly used for image formation. As illustrated in FIGURE, in the case of the charging device 3 of a contact charging device using a charging roller or the like, a pre-exposing device is not necessarily required.

In the present invention, among the above-mentioned components such as the electrophotographic photosensitive member 1, the charging device 3, the exposing device (not shown in drawing), the developing device 5, the transfer device 6, and the cleaning device 7, a plurality of the components including the electrophotographic photosensitive member 1 may be accommodated in a container to be integrally supported as a process cartridge. The process cartridge may be configured to be detachably attachable to a main body of the electrophotographic apparatus. For example, the electrophotographic photosensitive member 1 and at least one selected from the group consisting of the charging device 3, the developing device 5 and the cleaning device 7 are integrally supported to form a cartridge. Using a guide such as a rail of the main body of the electrophotographic apparatus, the process cartridge 9 can be detachably attachable to the main body of the electrophotographic apparatus.

In the case of the electrophotographic apparatus being a copier, the exposure light 4 may be the reflected light or the transmitted light from a manuscript. Alternatively, the exposure light 4 may be the light emitted by scanning of laser beam, driving of an LED array, driving of a liquid crystal shutter array, or the like according to the signals read from a manuscript by a sensor.

With reference to specific Examples, the present invention is described in more detail as follows. Hereinafter, the electrophotographic photosensitive member is also referred to simply as "photosensitive member".

Manufacturing Example of Electrophotographic Photosensitive Member (Manufacturing Example of Photosensitive Member 1)

An aluminum cylinder having a diameter of 30 mm and a length of 357.5 mm was prepared as the support (cylindrical electro-conductive support).

Next, 60 parts by mass of a barium sulfate particle coated with tin oxide (product name: Passtran PC1, made by Mitsui Mining & Smelting Co., Ltd.), 15 parts by mass of a titanium oxide particle (product name: TITANIX JR, made by Tayca Corporation), 43 parts by mass of a resol-type phenol resin (product name: Phenolite J-325 made by DIC Corporation (formerly known as Dainippon Ink and Chemicals, Inc.), solid content: 70% by mass), 0.015 parts by mass of silicone oil (product name: SH28PA, made by Dow Corning Toray Co., Ltd. (formerly known as Toray Silicone Co., Ltd.)), 3.6 parts by mass of a silicone resin particle (product name: Tospearl 120, made by Momentive Performance Materials Inc. (formerly known as Toshiba Silicone Co., Ltd.)), 50 parts by mass of 2-methoxy-1-propanol, and 50 parts by mass of methanol were put in a ball mill, and dispersed for 20 hours so as to prepare a coating liquid for an electro-conductive layer. The coating liquid for an electro-conductive layer was applied on the support by immersion coating, and the resultant coat was heated at 140° C. for 1 hour for curing, so that an electro-conductive layer having a film thickness of 15 μm was formed.

Next, in a mixed solvent of 400 parts by mass of methanol and 200 parts by mass of butanol, 10 parts by mass of a copolymerized nylon (product name: AMILAN CM8000, manufactured by Toray Industries, Inc.) and 30 parts by mass of a methoxymethylated nylon 6 resin (product name: TORESIN EF-30T, manufactured by Nagase ChemteX Corporation) were dissolved to prepare the coating liquid for an undercoat layer. The coating liquid for an undercoat layer was applied on the electro-conductive layer by immersion coating, and the resultant coat was dried at 100° C. for 30 minutes to form an undercoat layer having a film thickness of 0.45 μm.

Next, 20 parts by mass of a hydroxygallium phthalocyanine crystal (charge generating material) in a crystal form having strong peaks at Bragg angles (2θ)±0.2° of 7.4° and 28.2° in CuKα characteristic X-ray diffraction, 0.2 parts by mass of a calixarene compound represented by the following structural formula (1), 10 parts by mass of polyvinyl butyral (product name: S-LEC BX-1, manufactured by Sekisui Chemical Co., Ltd.) and 600 parts by mass of cyclohexanone were placed in a sand mill using glass beads having a diameter of 1 mm and subjected to dispersion treatment for 4 hours. Subsequently, 700 parts by mass of ethyl acetate was added to the resultant dispersion to prepare a coating liquid for a charge generating layer. The coating liquid for a charge generating layer was applied on the undercoat layer by immersion coating, and the resultant coat was dried at 80° C. for 15 minutes to form a charge generating layer having a film thickness of 0.17 μm.

(Manufacturing Examples of Photosensitive Members 2 to 4)

Electrophotographic photosensitive members were prepared in the same manner as in the Manufacturing Example of the photosensitive member 1, except that the additive amount (content) of the compound γ and the type and additive amount (content) of the compound δ were changed as described in Table 2. The detailed prescription and the manufacturing conditions of the coating liquid for a charge transporting layer are described in Table 2. The electrophotographic photosensitive members obtained are referred to as "photosensitive members 2 to 4". The measurement (1)

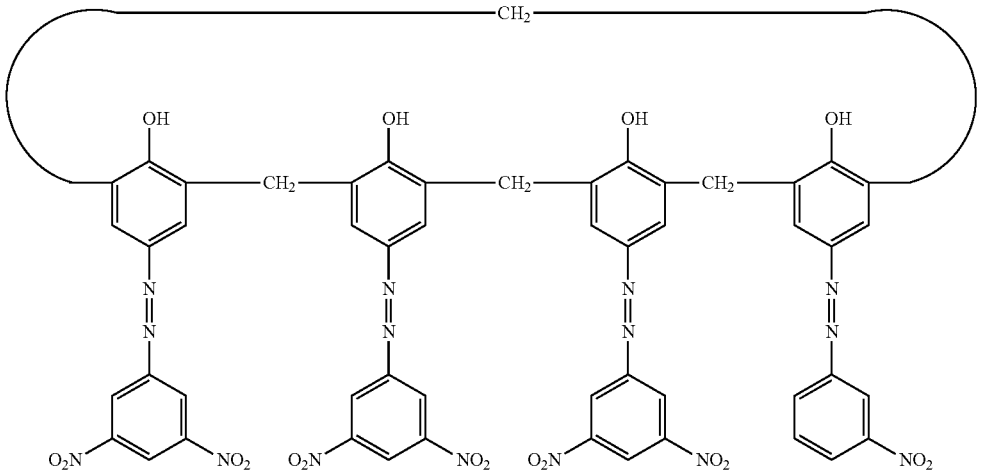

Next, 7.2 parts by mass of a compound (charge transporting material (hole transportable compound)) represented by the structural formula (E-1), 0.8 parts by mass of a compound (charge transporting material (hole transportable compound)) represented by the structural formula (E-2), 10 parts by mass of the above-mentioned resin B2 (refer to Table 1), 0.2 parts by mass of methoxytoluene, 48 parts by mass of methoxybenzene, and 35 parts by mass of dimethoxymethane (methylal) were mixed to prepare a coating liquid for a charge transporting layer.

The coating liquid for a charge transporting layer was applied on the charge generating layer by immersion coating, and the resultant coat was dried at 120° C. for 60 minutes to form a charge transporting layer having a film thickness of 30 μm.

An electrophotographic photosensitive member having a charge transporting layer as the surface layer was thus prepared.

A test piece having the above-mentioned sizes is cut out from the prepared electrophotographic photosensitive member, and the content Wγ of methoxybenzene (compound γ) and the content Wδ of 2-methoxytoluene (compound δ) were measured by gas chromatography according to the method described above. The content of methoxybenzene was 0.6% by mass, and the content of 2-methoxytoluene (compound δ) was 0.2% by mass. The detailed prescription and the manufacturing conditions of the coating liquid for a charge transporting layer are described in Table 2. The electrophotographic photosensitive member obtained is referred to as "photosensitive member 1". The measurement results of the contents Wγ and Wδ and the film thickness of the charge transporting layer are described in Table 6.

results of the contents Wγ and Wδ and the film thickness of the charge transporting layers are described in Table 6.

(Manufacturing Examples of Photosensitive Members 5 and 6)

Electrophotographic photosensitive members were prepared in the same manner as in the Manufacturing Example of the photosensitive member 1, except that the type of the resin α was changed as described in Table 2. The detailed prescription and the manufacturing conditions of the coating liquid for a charge transporting layer are described in Table 2. The electrophotographic photosensitive members obtained are referred to as "photosensitive members 5 and 6". The measurement results of the contents Wγ and Wδ and the film thickness of the charge transporting layers are described in Table 6.

(Manufacturing Examples of Photosensitive Members 7 to 25)

Electrophotographic photosensitive members were prepared in the same manner as in the Manufacturing Example of the photosensitive member 1, except that the additive amount (content) of the compound γ and the additive amount (content) of the compound δ, the amount of the other solvent, and the drying temperature and drying time were changed as described in Table 2. The detailed prescription and the manufacturing conditions of the coating liquid for a charge transporting layer are described in Table 2. The electrophotographic photosensitive members obtained are referred to as "photosensitive members 7 to 25". The measurement results of the contents Wγ and Wδ and the film thickness of the charge transporting layers are described in Table 6.

(Manufacturing Examples of Photosensitive Members 26 to 28)

Electrophotographic photosensitive members were prepared in the same manner as in the Manufacturing Example of the photosensitive member 1, except that the type of the resin α, the additive amount (content) of the compound γ and the additive amount (content) of the compound δ, the amount of the other solvent, and the drying time were changed as described in Table 2. The detailed prescription and the manufacturing conditions of the coating liquid for a charge transporting layer are described in Table 2. The electrophotographic photosensitive members obtained are referred to as "photosensitive members 26 to 28". The measurement results of the contents Wγ and Wδ and the film thickness of the charge transporting layers are described in Table 6.

(Manufacturing Examples of Photosensitive Members 29 to 34)

Electrophotographic photosensitive members were prepared in the same manner as in the Manufacturing Example of the photosensitive member 1, except that the additive amount (content) of the compound β, the mass ratio of the compound β, the additive amount (content) of the compound γ, the type of the compound δ, the additive amount (content) of the compound δ, the amount of the other solvent, and the drying time were changed as described in Table 2. The detailed prescription and the manufacturing conditions of the coating liquid for a charge transporting layer are described in Table 2. The electrophotographic photosensitive members obtained are referred to as "photosensitive members 29 to 34". The measurement results of the contents Wγ and Wδ and the film thickness of the charge transporting layers are described in Table 6.

(Manufacturing Example of Photosensitive Member 35)

An electrophotographic photosensitive member was prepared in the same manner as in the Manufacturing Example of the photosensitive member 1, except that methylal was changed to tetrahydrofuran (THF) in the Manufacturing Example of the photosensitive member 1. The detailed prescription and the manufacturing conditions of the coating liquid for a charge transporting layer are described in Table 2. The electrophotographic photosensitive member obtained is referred to as "photosensitive member 35". The measurement results of the contents Wγ and Wδ and the film thickness of the charge transporting layer are described in Table 6.

(Manufacturing Example of Photosensitive Member 36)

An electrophotographic photosensitive member was prepared in the same manner as in the Manufacturing Example of the photosensitive member 27, except that methylal was changed to tetrahydrofuran (THF) in the Manufacturing Example of the photosensitive member 27. The detailed prescription and the manufacturing conditions of the coating liquid for a charge transporting layer are described in Table 2. The electrophotographic photosensitive member obtained is referred to as "photosensitive member 36". The measurement results of the contents Wγ and Wδ and the film thickness of the charge transporting layer are described in Table 6.

(Manufacturing Examples of Photosensitive Members 37 and 38)

Electrophotographic photosensitive members were prepared in the same manner as in the Manufacturing Example of the photosensitive member 1, except that the additive amount (content) of the compound γ, the type of the compound δ, the additive amount (content) of the compound δ, the amount of the other solvent, and the drying temperature and the drying time were changed as described in Table 2. The detailed prescription and the manufacturing conditions of the coating liquid for a charge transporting layer are described in Table 2. The electrophotographic photosensitive members obtained are referred to as "photosensitive members 37 and 38". The measurement results of the contents Wγ and Wδ and the film thickness of the charge transporting layers are described in Table 6.

TABLE 2

| | α | | β | | γ | δ | | Other solvent | | Drying | Drying |
|---|---|---|---|---|---|---|---|---|---|---|---|
| | Binder | Parts by mass | CTM | Parts by mass | Parts by mass | Compound | Parts by mass | | Parts by mass | temperature [° C.] | time [min] |
| Photosensitive member 1 | Resin B2 | 10 | E1/E2 | 7.2/0.8 | 48 | 2-Methoxytoluene | 0.20 | Methylal | 35 | 120 | 60 |
| Photosensitive member 2 | Resin B2 | 10 | E1/E2 | 7.2/0.8 | 48 | 2-Methoxytoluene | 0.10 | Methylal | 35 | 120 | 60 |
| Photosensitive member 3 | Resin B2 | 10 | E1/E2 | 7.2/0.8 | 48 | 1-Methylhexanol | 0.10 | Methylal | 35 | 120 | 60 |
| Photosensitive member 4 | Resin B2 | 10 | E1/E2 | 7.2/0.8 | 49 | 3-Methylhexanol | 0.15 | Methylal | 35 | 120 | 60 |
| Photosensitive member 5 | Resin B1 | 10 | E1/E2 | 7.2/0.8 | 48 | 2-Methoxytoluene | 0.20 | Methylal | 35 | 120 | 60 |
| Photosensitive member 6 | Resin B3 | 10 | E1/E2 | 7.2/0.8 | 48 | 2-Methoxytoluene | 0.20 | Methylal | 35 | 120 | 60 |
| Photosensitive member 7 | Resin B2 | 10 | E1/E2 | 7.2/0.8 | 48 | 2-Methoxytoluene | 0.10 | Methylal | 35 | 125 | 120 |
| Photosensitive member 8 | Resin B2 | 10 | E1/E2 | 7.2/0.8 | 48 | 2-Methoxytoluene | 0.20 | Methylal | 35 | 120 | 120 |
| Photosensitive member 9 | Resin B2 | 10 | E1/E2 | 7.2/0.8 | 48 | 2-Methoxytoluene | 0.40 | Methylal | 35 | 120 | 120 |
| Photosensitive member 10 | Resin B2 | 10 | E1/E2 | 7.2/0.8 | 58 | 2-Methoxytoluene | 0.01 | Methylal | 25 | 120 | 40 |
| Photosensitive member 11 | Resin B2 | 10 | E1/E2 | 7.2/0.8 | 58 | 2-Methoxytoluene | 0.05 | Methylal | 25 | 120 | 40 |
| Photosensitive member 12 | Resin B2 | 10 | E1/E2 | 7.2/0.8 | 48 | 2-Methoxytoluene | 0.50 | Methylal | 35 | 120 | 30 |
| Photosensitive member 13 | Resin B2 | 10 | E1/E2 | 7.2/0.8 | 48 | 2-Methoxytoluene | 0.20 | Methylal | 35 | 120 | 90 |

TABLE 2-continued

| | α | | β | | γ | δ | | Other solvent | | Drying | Drying |
|---|---|---|---|---|---|---|---|---|---|---|---|
| | Binder | Parts by mass | CTM | Parts by mass | Parts by mass | Compound | Parts by mass | | Parts by mass | temperature [° C.] | time [min] |
| Photosensitive member 14 | Resin B2 | 10 | E1/E2 | 7.2/0.8 | 48 | 2-Methoxytoluene | 0.08 | Methylal | 35 | 120 | 45 |
| Photosensitive member 15 | Resin B2 | 10 | E1/E2 | 7.2/0.8 | 48 | 2-Methoxytoluene | 0.05 | Methylal | 35 | 115 | 60 |
| Photosensitive member 16 | Resin B2 | 10 | E1/E2 | 7.2/0.8 | 58 | 2-Methoxytoluene | 0.50 | Methylal | 25 | 120 | 30 |
| Photosensitive member 17 | Resin B2 | 10 | E1/E2 | 7.2/0.8 | 58 | 2-Methoxytoluene | 0.80 | Methylal | 25 | 120 | 30 |
| Photosensitive member 18 | Resin B2 | 10 | E1/E2 | 7.2/0.8 | 58 | 2-Methoxytoluene | 0.10 | Methylal | 25 | 120 | 30 |
| Photosensitive member 19 | Resin B2 | 10 | E1/E2 | 7.2/0.8 | 58 | 2-Methoxytoluene | 0.80 | Methylal | 25 | 120 | 30 |
| Photosensitive member 20 | Resin B2 | 10 | E1/E2 | 7.2/0.8 | 58 | 2-Methoxytoluene | 0.01 | Methylal | 25 | 120 | 30 |
| Photosensitive member 21 | Resin B2 | 10 | E1/E2 | 7.2/0.8 | 40 | 2-Methoxytoluene | 3.00 | Methylal | 43 | 130 | 120 |
| Photosensitive member 22 | Resin B2 | 10 | E1/E2 | 7.2/0.8 | 48 | 2-Methoxytoluene | 1.00 | Methylal | 35 | 115 | 60 |
| Photosensitive member 23 | Resin B2 | 10 | E1/E2 | 7.2/0.8 | 48 | 2-Methoxytoluene | 0.01 | Methylal | 35 | 120 | 20 |
| Photosensitive member 24 | Resin B2 | 10 | E1/E2 | 7.2/0.8 | 48 | 2-Methoxytoluene | 0.05 | Methylal | 35 | 120 | 20 |
| Photosensitive member 25 | Resin B2 | 10 | E1/E2 | 7.2/0.8 | 58 | 2-Methoxytoluene | 0.001 | Methylal | 25 | 120 | 20 |
| Photosensitive member 26 | Resin B3 | 10 | E1/E2 | 7.2/0.8 | 48 | 2-Methoxytoluene | 0.01 | Methylal | 35 | 120 | 20 |
| Photosensitive member 27 | Resin B3 | 10 | E1/E2 | 7.2/0.8 | 48 | 2-Methoxytoluene | 0.05 | Methylal | 35 | 120 | 20 |
| Photosensitive member 28 | Resin B3 | 10 | E1/E2 | 7.2/0.8 | 58 | 2-Methoxytoluene | 0.001 | Methylal | 25 | 120 | 20 |
| Photosensitive member 29 | Resin B2 | 10 | E1/E2 | 10/4.4 | 48 | 2-Methoxytoluene | 0.20 | Methylal | 35 | 120 | 60 |
| Photosensitive member 30 | Resin B2 | 10 | E1/E2 | 7.2/0.8 | 49 | 2-Methoxytoluene | 0.20 | Methylal | 36 | 120 | 40 |
| Photosensitive member 31 | Resin B2 | 10 | E1/E2 | 7.2/0.8 | 48 | 2-Methoxytoluene | 0.20 | Methylal | 35 | 120 | 60 |
| Photosensitive member 32 | Resin B2 | 10 | E1/E2 | 7.2/0.8 | 48 | 4-Methoxytoluene | 0.20 | Methylal | 35 | 120 | 60 |
| Photosensitive member 33 | Resin B2 | 10 | E1/E2 | 7.2/0.8 | 48 | Methoxycyclohexane | 0.10 | Methylal | 35 | 120 | 60 |
| Photosensitive member 34 | Resin B2 | 10 | E1/E2 | 5.6/1.4 | 48 | Methoxycyclohexane | 0.10 | Methylal | 35 | 120 | 60 |
| Photosensitive member 35 | Resin B2 | 10 | E1/E2 | 7.2/0.8 | 48 | 2-Methoxytoluene | 0.20 | THF | 35 | 120 | 60 |
| Photosensitive member 36 | Resin B3 | 10 | E1/E2 | 7.2/0.8 | 48 | 2-Methoxytoluene | 0.05 | THF | 35 | 120 | 20 |
| Photosensitive member 37 | Resin B2 | 10 | E1/E2 | 7.2/0.8 | 48 | 4-Methoxytoluene | 0.02 | Methylal | 35 | 120 | 20 |
| Photosensitive member 38 | Resin B2 | 10 | E1/E2 | 7.2/0.8 | 68 | 4-Methoxytoluene | 0.001 | Methylal | 25 | 125 | 30 |

(Manufacturing Examples of Photosensitive Members 101 to 105)

Electrophotographic photosensitive members were prepared in the same manner as in the Manufacturing Example of the photosensitive member 1, except that the type of the compound β, the additive amount (content) of the compound β, the mass ratio of the compound β, the additive amount (content) of the compound γ, the additive amount (content) of the compound δ were changed as described in Table 3. The detailed prescription and the manufacturing conditions of the coating liquid for a charge transporting layer are described in Table 3. The electrophotographic photosensitive members obtained are referred to as "photosensitive members 101 to 105". The measurement results of the contents Wγ and Wδ and the film thickness of the charge transporting layers are described in Table 7.

(Manufacturing Examples of Photosensitive Members 106 to 109)

Electrophotographic photosensitive members were prepared in the same manner as in the Manufacturing Example of the photosensitive member 1, except that the type of the resin α, the type of the compound β, the mass ratio of the compound β, and the additive amount (content) of the compound γ were changed as described in Table 3. The detailed prescription and the manufacturing conditions of the coating liquid for a charge transporting layer are described in Table 3. The electrophotographic photosensitive members obtained are referred to as "photosensitive members 106 to 109". The measurement results of the contents Wγ and Wδ and the film thickness of the charge transporting layers are described in Table 7.

(Manufacturing Examples photosensitive members 110 and 111)

Electrophotographic photosensitive members were prepared in the same manner as in the Manufacturing Example of the photosensitive member 1, except that the type of the compound β, the mass ratio of the compound β, and the additive amount (content) of the compound γ, the additive amount (content) of the compound δ, the amount of the other solvent, and the drying time were changed as described in Table 3. The detailed prescription and the manufacturing conditions of the coating liquid for a charge transporting layer are described in Table 3. The electrophotographic photosensitive members obtained are referred to as "photosensitive members 110 and 111". The measurement results of the contents Wγ and Wδ and the film thickness of the charge transporting layers are described in Table 7.

TABLE 3

| | α | | β | | γ | δ | | Other solvent | | Drying | Drying |
|---|---|---|---|---|---|---|---|---|---|---|---|
| | Binder | Parts by mass | CTM | Parts by mass | Parts by mass | Compound | Parts by mass | | Parts by mass | temperature [° C.] | time [min] |
| Photosensitive member 101 | Resin B2 | 10 | E1/E4 | 4/4 | 48 | 2-Methoxytoluene | 0.20 | Methylal | 35 | 120 | 60 |
| Photosensitive member 102 | Resin B2 | 10 | E1/E3 | 4/4 | 48 | 2-Methoxytoluene | 0.10 | Methylal | 35 | 120 | 60 |
| Photosensitive member 103 | Resin B2 | 10 | E5/E6 | 4/4 | 48 | 2-Methoxytoluene | 0.20 | Methylal | 35 | 120 | 60 |
| Photosensitive member 104 | Resin B2 | 10 | E4/E7 | 4/4 | 48 | 2-Methoxytoluene | 0.20 | Methylal | 35 | 120 | 60 |
| Photosensitive member 105 | Resin B2 | 10 | E9 | 4 | 49 | 2-Methoxytoluene | 0.20 | Methylal | 35 | 120 | 60 |
| Photosensitive member 106 | Resin B1 | 10 | E3 | 8 | 49 | 2-Methoxytoluene | 0.20 | Methylal | 35 | 120 | 60 |
| Photosensitive member 107 | Resin B3 | 10 | E3/E8 | 4/4 | 48 | 2-Methoxytoluene | 0.20 | Methylal | 35 | 120 | 60 |
| Photosensitive member 108 | Resin B3 | 10 | E5/E6 | 4/4 | 48 | 2-Methoxytoluene | 0.20 | Methylal | 35 | 120 | 60 |
| Photosensitive member 109 | Resin B3 | 10 | E7 | 8 | 48 | 2-Methoxytoluene | 0.20 | Methylal | 35 | 120 | 60 |
| Photosensitive member 110 | Resin B2 | 10 | E1/E4 | 7.2/0.8 | 48 | 2-Methoxytoluene | 0.10 | Methylal | 35 | 120 | 120 |
| Photosensitive member 111 | Resin B2 | 10 | E1/E4 | 7.2/0.8 | 58 | 2-Methoxytoluene | 0.01 | Methylal | 25 | 120 | 40 |

(Manufacturing Examples of Photosensitive Members 201 to 205)

Electrophotographic photosensitive members were prepared in the same manner as in the Manufacturing Example of the photosensitive member 1, except that the type of the resin α, the mass ratio of the compound β, and the additive amount (content) of the compound γ, the additive amount (content) of the compound δ were changed as described in Table 4. The detailed prescription and the manufacturing conditions of the coating liquid for a charge transporting layer are described in Table 4. The electrophotographic photosensitive members obtained are referred to as "photosensitive members 201 to 205". The measurement results of the contents Wγ and Wδ and the film thickness of the charge transporting layers are described in Table 8.

TABLE 4

| | α | | β | | γ | δ | | Other solvent | | Drying | Drying |
|---|---|---|---|---|---|---|---|---|---|---|---|
| | Binder | Parts by mass | CTM | Parts by mass | Parts by mass | Compound | Parts by mass | | Parts by mass | temperature [° C.] | time [min] |
| Photosensitive member 201 | Resin A1 | 10 | E1/E2 | 5.6/2.4 | 48 | 2-Methoxytoluene | 0.20 | Methylal | 35 | 120 | 60 |
| Photosensitive member 202 | Resin A1 | 10 | E1/E2 | 5.6/2.4 | 48 | 2-Methoxytoluene | 0.10 | Methylal | 35 | 120 | 60 |
| Photosensitive member 203 | Resin A2 | 10 | E1/E2 | 5.6/2.4 | 48 | 2-Methoxytoluene | 0.20 | Methylal | 35 | 120 | 60 |
| Photosensitive member 204 | Resin A3 | 10 | E1/E2 | 5.6/2.4 | 49 | 2-Methoxytoluene | 0.20 | Methylal | 35 | 120 | 60 |
| Photosensitive member 205 | Resin A1/ Resin A4 | 9/1 | E1/E2 | 5.6/2.4 | 48 | 2-Methoxytoluene | 0.2 | Methylal | 35 | 120 | 60 |

(Manufacturing Examples of Photosensitive Members 1001 to 1003)

Electrophotographic photosensitive members were prepared in the same manner as in the Manufacturing Example of the photosensitive member 1, except that the additive amount (content) of the compound γ, the type of the compound δ, the additive amount (content) of the compound δ, and the drying time were changed as described in Table 5. The detailed prescription and the manufacturing conditions of the coating liquid for a charge transporting layer are described in Table 5. The electrophotographic photosensitive members obtained are referred to as "photosensitive members 1001 to 1003". The measurement results of the contents Wγ and Wδ and the film thickness of the charge transporting layers are described in Table 9.

TABLE 5

| | α | | β | | γ | δ | | Other solvent | | Drying | Drying |
|---|---|---|---|---|---|---|---|---|---|---|---|
| | Binder | Parts by mass | CTM | Parts by mass | Parts by mass | Compound | Parts by mass | | Parts by mass | temperature [° C.] | time [min] |
| Photosensitive member 1001 | Resin B2 | 10 | E1/E2 | 7.2/0.8 | 48 | — | 0 | Methylal | 35 | 120 | 60 |
| Photosensitive member 1002 | Resin B2 | 10 | E1/E2 | 7.2/0.8 | 48 | 2-Methoxytoluene | 10 | Methylal | 35 | 120 | 60 |
| Photosensitive member 1003 | Resin B2 | 10 | E1/E2 | 7.2/0.8 | 28 | Toluene | 20 | Methylal | 35 | 120 | 30 |

Evaluation of Electrophotographic Photosensitive Member on Actual Machine

Example 1

Evaluation on Initial Image

A prepared photosensitive member 1 was installed on the cyan station of a modified electrophotographic apparatus (multifunction device) manufactured by Canon Inc. (product name: iR-ADV C5255) as evaluation apparatus to perform the following test and evaluation.

First, under an environment at a temperature of 23° C. and a humidity of 50% RH, the conditions of a charging apparatus and an image exposure apparatus were set such that the electrophotographic photosensitive member has a dark part potential (Vd) of −700 V and a bright part potential (V1) of −200 V. The initial potential of the electrophotographic photosensitive member was thus adjusted.

Next, the screen image with a cyan concentration of 30% was outputted as a half-tone image to confirm whether no image defect occurred.

<Evaluation on Potential Variation>

In order to measure the surface potential of the electrophotographic photosensitive member (dark part potential and light part potential), the cartridge of the evaluation apparatus was modified by replacing the developing machine with a fixed jig having a potential measuring probe at a position (approximately the center) 178 mm away from the edge of the electrophotographic photosensitive member, and the measurement was performed at the development position. The applied bias was set such that the non-exposed portion of the electrophotographic photosensitive member had a dark part potential of −700 V. The bright part potential (initial bright part potential in the Table) attenuated by irradiating laser light (0.26 μJ/cm$^2$) was measured. Further, an image was continuously outputted to 2,000 sheets of A4 size plain paper, and the bright part potential (bright part potential after endurance in the Table) was then measured. Further, the difference Δ between the bright part potential after image output and the bright part potential before image output was calculated. The results are described in Table 6.

<Evaluation on Storage Stability>

The test and evaluation on the storage stability of an electrophotographic photosensitive member were performed as follows.

First, an electrophotographic photosensitive member was stored under an environment at a temperature of 50° C. and a humidity of 95% RH for 30 days. After the subsequent storage at 23° C./50% RH for 30 days, the screen image with a cyan concentration of 30% was outputted as a half-tone image to confirm no image defects according to the following criteria, using the evaluation machine in the same manner as in the case of the initial image.

The surface of the photosensitive member was then observed by a microscope to confirm whether no precipitation of the charge transporting material and no crack in the charge transporting layer occurred. The results are described in Table 6.

A: The image after the storage stability test had no image defect, and no precipitation of the charge transporting material was confirmed by observation of the photosensitive member surface.

B: Although the image after the storage stability test had no image defect, something like precipitation of the charge transporting material was confirmed by observation of the photosensitive member surface.

C: Although the image after the storage stability test had no image defect, partial precipitation of the charge transporting material was confirmed, and no cracks were confirmed in the charge transporting layer, by observation of the photosensitive member surface.

D: Although the image after the storage stability test had no image defect, precipitation of the charge transporting material was confirmed by observation of the photosensitive member surface. Although a small amount of something like cracks were observed in some cases, it was not confirmed whether those were cracks.

E: The image after the storage stability test had noticeable image defects such as black spots, and precipitation of the charge transporting material and cracks were confirmed by observation of the photosensitive member surface.

Examples 2 to 38

The evaluation was performed in the same manner as in Example 1, except that the photosensitive member 1 was replaced with one of photosensitive members 2 to 38. The results are described in Table 6.

Examples 101 to 111

The evaluation was performed in the same manner as in Example 1, except that the photosensitive member 1 was replaced with one of photosensitive members 101 to 111, and no potential evaluation was made. The results are described in Table 7.

Examples 201 to 205

The evaluation was performed in the same manner as in Example 1, except that the photosensitive member 1 was replaced with one of photosensitive members 201 to 205. The results are described in Table 8.

Comparative Examples 1 to 3

The evaluation was performed in the same manner as in Example 1, except that the photosensitive member 1 was replaced with one of photosensitive members 1001 to 1003. The results are described in Table 9.

TABLE 6

| | Photosensitive member | Wγ Content [%] | Wδ Content [%] | Wγ/Wδ Content ratio | Film thickness [μm] | Precipitation/ Crack | Initial bright part potential [V] | Bright part potential after endurance [V] | Δ [V] |
|---|---|---|---|---|---|---|---|---|---|
| Example 1 | Photosensitive member 1 | 0.6 | 0.2 | 3 | 30 | A | −170 | −185 | −15 |
| Example 2 | Photosensitive member 2 | 0.5 | 0.1 | 5 | 30 | A | −173 | −186 | −13 |
| Example 3 | Photosensitive member 3 | 0.6 | 0.7 | 0.86 | 30 | B | −176 | −196 | −20 |
| Example 4 | Photosensitive member 4 | 0.6 | 1 | 0.6 | 30 | B | −178 | −195 | −17 |
| Example 5 | Photosensitive member 5 | 0.6 | 0.2 | 3 | 30 | A | −170 | −183 | −13 |
| Example 6 | Photosensitive member 6 | 0.6 | 0.2 | 3 | 30 | A | −165 | −178 | −13 |
| Example 7 | Photosensitive member 7 | 0.001 | 0.001 | 1 | 30 | B | −175 | −190 | −15 |
| Example 8 | Photosensitive member 8 | 0.001 | 0.1 | 0.01 | 30 | B | −170 | −188 | −18 |
| Example 9 | Photosensitive member 9 | 0.001 | 0.5 | 0.002 | 30 | A | −171 | −183 | −12 |
| Example 10 | Photosensitive member 10 | 0.9 | 0.005 | 180 | 30.1 | B | −172 | −185 | −13 |
| Example 11 | Photosensitive member 11 | 1 | 0.001 | 1000 | 30.1 | A | −171 | −183 | −12 |
| Example 12 | Photosensitive member 12 | 1 | 0.5 | 2 | 30 | A | −171 | −188 | −17 |
| Example 13 | Photosensitive member 13 | 0.05 | 0.1 | 0.5 | 30 | A | −170 | −186 | −16 |
| Example 14 | Photosensitive member 14 | 0.5 | 0.001 | 500 | 30 | B | −170 | −185 | −15 |
| Example 15 | Photosensitive member 15 | 1.1 | 0.005 | 220 | 30 | A | −170 | −185 | −15 |
| Example 16 | Photosensitive member 16 | 1.2 | 0.5 | 2.4 | 30 | A | −170 | −185 | −15 |
| Example 17 | Photosensitive member 17 | 1.2 | 1 | 1.2 | 30 | A | −169 | −185 | −16 |
| Example 18 | Photosensitive member 18 | 2 | 0.2 | 10 | 30 | B | −170 | −183 | −13 |
| Example 19 | Photosensitive member 19 | 2 | 1 | 2 | 30 | B | −175 | −188 | −13 |
| Example 20 | Photosensitive member 20 | 2 | 0.001 | 2000 | 30 | B | −170 | −185 | −15 |
| Example 21 | Photosensitive member 21 | 0.01 | 1 | 0.01 | 30 | B | −170 | −190 | −20 |
| Example 22 | Photosensitive member 22 | 1 | 1 | 1 | 30 | B | −170 | −188 | −18 |
| Example 23 | Photosensitive member 23 | 3 | 0.2 | 15 | 30 | C | −175 | −190 | −15 |
| Example 24 | Photosensitive member 24 | 3 | 1 | 3 | 30 | C | −173 | −193 | −20 |
| Example 25 | Photosensitive member 25 | 3 | 0.001 | 3000 | 30 | C | −173 | −190 | −17 |
| Example 26 | Photosensitive member 26 | 3 | 0.2 | 15 | 30 | C | −174 | −192 | −18 |
| Example 27 | Photosensitive member 27 | 3 | 1 | 3 | 30 | C | −174 | −193 | −19 |
| Example 28 | Photosensitive member 28 | 3 | 0.001 | 3000 | 30 | C | −174 | −193 | −19 |

TABLE 6-continued

| | Photosensitive member | Wγ Content [%] | Wδ Content [%] | Wγ/Wδ Content ratio | Film thickness [μm] | Precipitation/ Crack | Initial bright part potential [V] | Bright part potential after endurance [V] | Δ [V] |
|---|---|---|---|---|---|---|---|---|---|
| Example 29 | Photosensitive member 29 | 0.6 | 0.2 | 3 | 30 | A | −158 | −170 | −12 |
| Example 30 | Photosensitive member 30 | 0.1 | 0.03 | 3.33 | 20 | A | −170 | −185 | −15 |
| Example 31 | Photosensitive member 31 | 0.6 | 0.2 | 3 | 15 | A | −178 | −195 | −17 |
| Example 32 | Photosensitive member 32 | 0.6 | 0.1 | 6 | 15 | A | −170 | −186 | −16 |
| Example 33 | Photosensitive member 33 | 0.6 | 0.5 | 1.2 | 15 | B | −172 | −186 | −14 |
| Example 34 | Photosensitive member 34 | 0.6 | 0.5 | 1.2 | 15 | A | −180 | −194 | −14 |
| Example 35 | Photosensitive member 35 | 0.6 | 0.2 | 3 | 30 | A | −184 | −200 | −16 |
| Example 36 | Photosensitive member 36 | 3 | 1 | 3 | 30 | C | −182 | −199 | −17 |
| Example 37 | Photosensitive member 37 | 3 | 0.8 | 3.75 | 30 | C | −170 | −189 | −19 |
| Example 38 | Photosensitive member 38 | 3 | 0.001 | 3000 | 30 | C | −172 | −191 | −19 |

TABLE 7

| | Photosensitive member | Wγ Content [%] | Wδ Content [%] | Wγ/Wδ Content ratio | Film thickness [μm] | Precipitation/ Crack | Initial bright part potential [V] | Bright part potential after endurance [V] | Δ [V] |
|---|---|---|---|---|---|---|---|---|---|
| Example 101 | Photosensitive member 101 | 0.6 | 0.2 | 3 | 30 | A | — | — | — |
| Example 102 | Photosensitive member 102 | 0.5 | 0.1 | 5 | 30 | A | — | — | — |
| Example 103 | Photosensitive member 103 | 0.6 | 0.2 | 3 | 30 | A | — | — | — |
| Example 104 | Photosensitive member 104 | 0.6 | 0.2 | 3 | 30 | A | — | — | — |
| Example 105 | Photosensitive member 105 | 0.6 | 0.2 | 3 | 30 | A | — | — | — |
| Example 106 | Photosensitive member 106 | 0.6 | 0.2 | 3 | 30 | A | — | — | — |
| Example 107 | Photosensitive member 107 | 0.6 | 0.2 | 3 | 30 | A | — | — | — |
| Example 108 | Photosensitive member 108 | 0.6 | 0.2 | 3 | 30 | A | — | — | — |
| Example 109 | Photosensitive member 109 | 0.6 | 0.2 | 3 | 30 | A | — | — | — |
| Example 110 | Photosensitive member 110 | 0.001 | 0.001 | 1 | 30 | B | — | — | — |
| Example 111 | Photosensitive member 111 | 0.9 | 0.005 | 180 | 30.1 | B | — | — | — |

TABLE 8

| | Photosensitive member | Wγ Content [%] | Wδ Content [%] | Wγ/Wδ Content ratio | Film thickness [μm] | Precipitation/ Crack | Initial bright part potential [V] | Bright part potential after endurance [V] | Δ [V] |
|---|---|---|---|---|---|---|---|---|---|
| Example 201 | Photosensitive member 201 | 0.3 | 0.2 | 1.5 | 18 | A | −160 | −172 | −12 |
| Example 202 | Photosensitive member 202 | 0.2 | 0.1 | 2 | 18 | A | −156 | −165 | −9 |
| Example 203 | Photosensitive member 203 | 0.3 | 0.1 | 3 | 18 | A | −161 | −171 | −10 |
| Example 204 | Photosensitive member 204 | 0.3 | 0.2 | 1.5 | 18 | A | −165 | −176 | −11 |
| Example 205 | Photosensitive member 205 | 0.3 | 0.2 | 1.5 | 18 | A | −163 | −172 | −9 |

TABLE 9

| | Photosensitive member | Wγ Content [%] | Wδ Content [%] | Wγ/Wδ Content ratio | Film thickness [μm] | Precipitation/ Crack | Initial bright part potential [V] | Bright part potential after endurance [V] | Δ [V] |
|---|---|---|---|---|---|---|---|---|---|
| Comparative Example 1 | Photosensitive member 1001 | 0.6 | — | — | 30 | E | −170 | −188 | −18 |
| Comparative Example 2 | Photosensitive member 1002 | 0.6 | 3 | 0.2 | 30 | E | −170 | −195 | −25 |
| Comparative Example 3 | Photosensitive member 1003 | 0.4 | 0.2 | 2 | 30 | E | −178 | −195 | −17 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-072654, filed Mar. 31, 2015 and No. 2016-051294, filed Mar. 15, 2016, which are hereby incorporated by reference herein in their entirety.

What is claimed is:

1. An electrophotographic photosensitive member comprising:

a support, and a photosensitive layer on the support, the photosensitive layer comprising a charge generating layer containing a charge generating material, and a charge transporting layer containing a charge transporting material, in this order, wherein the charge transporting layer contains:

(α) at least one selected from the group consisting of a polycarbonate resin having a structural unit represented by formula (A), and a polyester resin having a structural unit represented by formula (B);

(β) the charge transporting material;

(γ) a methoxybenzene; and (δ) at least one compound selected from the group consisting of a methoxycyclohexane, and a methoxybenzene having a methyl group or an ethyl group as a substituent, the content Wδ of (δ) being 0.001 to 1% by mass based on the total mass of the charge transporting layer:

(A)

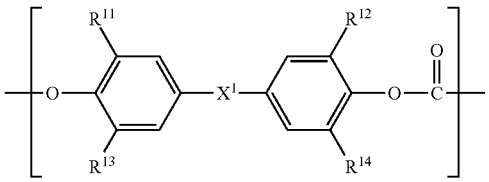

(B)

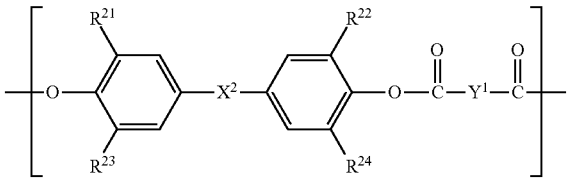

where $R^{11}$ to $R^{14}$, and $R^{21}$ to $R^{24}$ each independently represent a hydrogen atom, a methyl group, or an ethyl group;

$X^1$ and $X^2$ each independently represent a single bond or a divalent hydrocarbon group; and $Y^1$ represents a phenylene group or a diphenylene ether group.

2. The electrophotographic photosensitive member according to claim 1, wherein the methoxybenzene having a methyl group or an ethyl group as a substituent is methoxytoluene.

3. The electrophotographic photosensitive member according to claim 1, wherein the content Wγ of (γ) is 0.001 to 2% by mass based on the total mass of the charge transporting layer.

4. The electrophotographic photosensitive member according to claim 1, wherein the content Wγ of (γ) is 0.001 to 1% by mass based on the total mass of the charge transporting layer, the content Wδ of (δ) is 0.001 to 0.5% by mass based on the total mass of the charge transporting layer, and the ratio Wγ/Wδ of the content Wγ of (γ) to the content Wδ of (δ) is 0.5 to 200.

5. The electrophotographic photosensitive member according to claim 1, wherein (β) is a compound having a structure represented by formula (E):

(E)

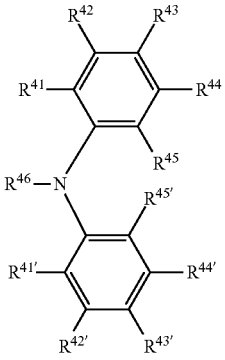

wherein $R^{41}$ to $R^{46}$, and $R^{41'}$ to $R^{45'}$ each independently represent a hydrogen atom, a methyl group, an ethyl group, a substituted or unsubstituted aryl group, or an unsaturated hydrocarbon group.

6. A process cartridge detachably attachable to a main body of an electrophotographic apparatus, wherein the process cartridge integrally supports an electrophotographic photosensitive member; and at least one device selected from the group consisting of:

a charging device for charging the electrophotographic photosensitive member, an exposing device for forming an electrostatic latent image on the surface of the electrophotographic photosensitive member by irradiating the surface of the electrophotographic photosensitive member with exposure light, a developing device for forming a toner image on the surface of the electrophotographic photosensitive member by toner development of the electrostatic latent image, and a transfer device for transferring the toner image from the surface of the electrophotographic photosensitive member to a transfer material, and a cleaning device for cleaning the surface of the electrophotographic photosensitive member;

the electrophotographic photosensitive member comprising:

a support, and a photosensitive layer on the support, the photosensitive layer comprising a charge generating layer containing a charge generating material, and a charge transporting layer containing a charge transporting material, in this order, wherein the charge transporting layer contains:

(α) at least one selected from the group consisting of a polycarbonate resin having a structural unit represented by formula (A), and a polyester resin having a structural unit represented by formula (B);

(β) the charge transporting material;

(γ) a methoxybenzene; and (δ) at least one compound selected from the group consisting of a methoxycyclohexane, and a methoxybenzene having a methyl group or an ethyl group as a substituent, the content Wδ of (δ) being 0.001 to 1% by mass based on the total mass of the charge transporting layer:

(A)

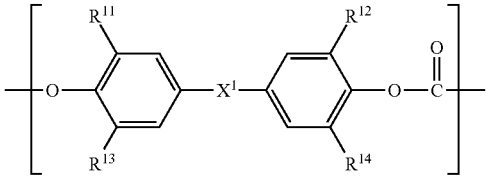

(B)

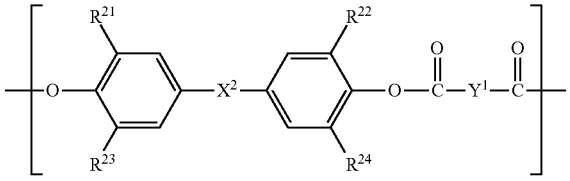

where $R^{11}$ to $R^{14}$, and $R^{21}$ to $R^{24}$ each independently represent a hydrogen atom, a methyl group, or an ethyl group;

$X^1$ and $X^2$ each independently represent a single bond or a divalent hydrocarbon group; and $Y^1$ represents a phenylene group or a diphenylene ether group.

7. An electrophotographic apparatus comprising:

an electrophotographic photosensitive member;

a charging device for charging the electrophotographic photosensitive member;

an exposing device for forming an electrostatic latent image on the surface of the electrophotographic photosensitive member by irradiating the surface of the electrophotographic photosensitive member with exposure light;

a developing device for forming a toner image on the surface of the electrophotographic photosensitive member by toner development of the electrostatic latent image; and a transfer device for transferring the toner image from the surface of the electrophotographic photosensitive member to a transfer material, the electrophotographic photosensitive member comprising:

a support, and a photosensitive layer on the support, the photosensitive layer comprising a charge generating layer containing a charge generating material, and a charge transporting layer containing a charge transporting material, in this order, wherein the charge transporting layer contains:

(α) at least one selected from the group consisting of a polycarbonate resin having a structural unit represented by formula (A), and a polyester resin having a structural unit represented by formula (B);

(β) the charge transporting material;

(γ) a methoxybenzene; and (δ) at least one compound selected from the group consisting of a methoxycyclohexane, and a methoxybenzene having a methyl group or an ethyl group as a substituent, the content Wδ of (δ) being 0.001 to 1% by mass based on the total mass of the charge transporting layer:

(A)

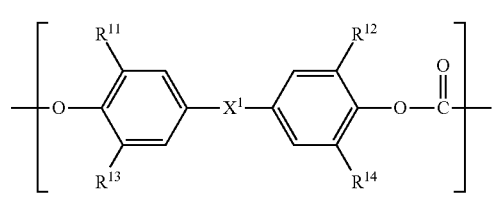

(B)

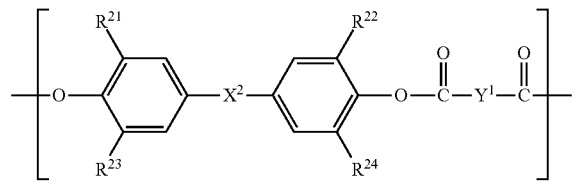

where $R^{11}$ to $R^{14}$, and $R^{21}$ to $R^{24}$ each independently represent a hydrogen atom, a methyl group, or an ethyl group;

$X^1$ and $X^2$ each independently represent a single bond or a divalent hydrocarbon group; and $Y^1$ represents a phenylene group or a diphenylene ether group.

* * * * *